US006963264B2

(12) United States Patent
Iwamoto et al.

(10) Patent No.: US 6,963,264 B2
(45) Date of Patent: Nov. 8, 2005

(54) ALLOY TYPE THERMAL FUSE AND WIRE MEMBER FOR A THERMAL FUSE ELEMENT

(75) Inventors: Miki Iwamoto, Osaka (JP); Naotaka Ikawa, Osaka (JP); Toshiaki Saruwatari, Osaka (JP); Yoshiaki Tanaka, Osaka (JP)

(73) Assignee: Uchihashi Estec Co., Ltd., Osaka (JP)

( * ) Notice: Subject to any disclaimer, the term of this patent is extended or adjusted under 35 U.S.C. 154(b) by 52 days.

(21) Appl. No.: 10/608,478

(22) Filed: Jun. 27, 2003

(65) Prior Publication Data

US 2004/0066268 A1 Apr. 8, 2004

(30) Foreign Application Priority Data

Jul. 11, 2002 (JP) ..... P2002-203127

(51) Int. Cl.[7] ..... H01H 85/06; H01H 85/055; C22C 13/02

(52) U.S. Cl. ..... 337/296; 337/290; 337/159; 420/562

(58) Field of Search ..... 337/290, 296, 337/295, 297, 159, 160, 416; 29/623; 420/562, 571, 572, 576, 577; 148/433

(56) References Cited

U.S. PATENT DOCUMENTS 3,201,646 A * 8/1965 Mansfield, Jr. ..... 315/239
3,386,063 A * 5/1968 Mansfield, Jr ..... 337/191
3,940,728 A * 2/1976 Komatsu et al. ..... 337/290
4,198,617 A * 4/1980 Hara ..... 337/403
4,622,534 A * 11/1986 Bowman ..... 337/404
5,712,610 A * 1/1998 Takeichi et al. ..... 337/290
5,833,921 A 11/1998 Paruchuri et al.
5,898,357 A * 4/1999 Endo et al. ..... 337/159
6,064,293 A * 5/2000 Jungst et al. ..... 337/290

FOREIGN PATENT DOCUMENTS

| | | | | |
|---|---|---|---|---|
| GB | 2148626 A | * | 5/1995 | ..... H01H/85/06 |
| JP | 57-58011 A | | 4/1982 | |
| JP | 59-8231 A | | 1/1984 | |
| JP | 02025533 A | | 1/1990 | |
| JP | 04012428 A | * | 1/1992 | ..... H01H/85/06 |
| JP | 2001-334386 A | | 12/2001 | |
| JP | 2002-25404 A | | 1/2002 | |
| JP | 2003-147461 A | | 5/2003 | |

* cited by examiner

*Primary Examiner*—Anatoly Vortman
(74) *Attorney, Agent, or Firm*—Akin Gump Strauss Hauer & Feld, LLP

(57) ABSTRACT

The invention relates to an alloy type thermal fuse and a wire member for a thermal fuse element, and provides an alloy type thermal fuse in which a fuse element does not contain a harmful metal, the operating temperature is about 150° C., the dispersion of the operating temperature can be sufficiently suppressed, and the operation stability to a heat cycle can be satisfactorily assured. The thermal fuse has an alloy composition of 30 to 70% Sn, 0.3 to 20% Sb, and a balance Bi.

12 Claims, 3 Drawing Sheets

ALLOY TYPE THERMAL FUSE AND WIRE MEMBER FOR A THERMAL FUSE ELEMENT

BACKGROUND OF THE INVENTION

1. Field of the Invention

The present invention relates to an alloy type thermal fuse and a wire member for a thermal fuse element, and is useful as a thermoprotector for an electrical appliance or a circuit element.

An alloy type thermal fuse is widely used as a thermoprotector for an electrical appliance or a circuit element, for example, a semiconductor device, a capacitor, or a resistor.

Such an alloy type thermal fuse has a configuration in which an alloy of a predetermined melting point is used as a fuse element, a flux is applied to the fuse element, and the flux-applied fuse element is sealed by an insulator.

The alloy type thermal fuse has the following operation mechanism.

The alloy type thermal fuse is disposed so as to thermally contact an electrical appliance or a circuit element which is to be protected. When the electrical appliance or the circuit element is caused to generate heat by any ab-normality, the fuse element alloy of the thermal fuse is melted by the generated heat, and the molten alloy is divided and spheroidized because of the wettability with respect to a lead conductor or an electrode under the coexistence with the flux that has already melted. The power supply is finally interrupted as a result of advancement of the division and spheroidization. The temperature of the appliance is lowered by the power supply interruption, and the divided molten alloys are solidified, whereby the non-return cut-off operation is completed. In an alloy type thermal fuse, therefore, it is requested that the division temperature of the fuse element alloy is substantially equal to the allowable temperature of an electrical appliance or the like.

Usually, a low-melting alloy is used as such a fuse element. As apparent from a phase equilibrium diagram, an alloy has a solidus temperature and a liquidus temperature, and, at the eutectic point where the solidus temperature coincides with the liquidus temperature, the alloy is changed all at once from the solid phase to the liquid phase by heating which causes the alloy to pass the eutectic temperature. By contrast, in a composition other than the eutectic point, an alloy is changed in the sequence of the solid phase→the solid-liquid coexisting phase→the liquid phase, and the solid-liquid coexisting region temperature width $\Delta T$ exists between the solidus temperature Ts and the liquidus temperature Tl. Even in the solid-liquid coexisting region, there is the possibility that the division of a fuse element occurs, although the possibility is low. In order to reduce the dispersion of the operating temperature among thermal fuses, it is requested to use an alloy composition in which the solid-liquid coexisting region temperature width $\Delta T$ is as narrow as possible. One of conditions imposed on an alloy type thermal fuse is that $\Delta T$ is narrow.

When $\Delta T$ is large, the following disadvantage is caused in addition to the above-mentioned large dispersion of the operating temperature. In the case where the upper limit temperature of a normal heat cycle reaches the solidus temperature, even when a fuse element is not broken in the heat cycle, the initial state of a semi-molten state (solid-liquid coexisting state) occurs. During a temperature lowering process in a heat cycle, the alloy is resolidified. The repetition of the semi-melting and the resolidification causes the operation characteristic to be disturbed, so that the operation stability to a heat cycle is impaired.

Even when the solidus temperature is not lower than the upper limit temperature of a normal heat cycle, a large slip which may be caused in the interface between different phases in the alloy structure is increased depending on the ductility of the fuse element. Such a slip is repeatedly caused as a result of a heat cycle, so that a change of a sectional area or an elongation of the element occurs in an excessive manner. From this point of view, the operation stability to a heat cycle cannot be often assured.

In many cases, a fuse element of an alloy type thermal fuse is used in the form of a linear piece. In order to reduce the size of a thermal fuse so as to comply with the recent tendency that appliances are further miniaturized, it is sometimes demanded to realize a thin fuse element. A fuse element is often requested to have drawability to a small diameter (for example, 400 $\mu m\phi$ or smaller).

Another one of the conditions imposed on an alloy type thermal fuse is that the electrical resistance is low. The temperature rise of a fuse element by Joule's heat in a normal state is indicated by $\Delta T'$. The operating temperature is lower than that in the case where such a temperature rise does not occur. As $\Delta T'$ is higher, the operation error is larger. In order to suppress Joule's heat, therefore, a fuse element is requested to have a low specific resistance. The resistance of a fuse element is inversely proportional to the sectional area of the fuse element. In order to meet the requirement of thinning, therefore, a fuse element is requested to have a lower specific resistance.

In recent electrical appliances, the use of materials harmful to a living body, particularly metals such as Pb, Cd, Hg, and Tl is restricted because of increased awareness of environment conservation. Also a fuse element for a thermal fuse is requested not to contain such a harmful metal.

2. Description of the Prior Art

When alloy type thermal fuses are classified according to operating temperature, thermal fuses of an operating temperature of about 150° C. are widely used.

Such a thermal fuse, known are a thermal fuse in which an alloy of 49.8Sn-31.96Pb-18.11Cd (the weight composition of the alloy of 49.8% Sn, 31.96% Pb, and 18.11% Cd, this indication method of an alloy composition is employed in the following description) is used as a fuse element, and which has an operating temperature of 145° C. (Japanese Patent Application Laying-Open No. 57-58011), and that in which an alloy of 54Sn-25Pb-21In is used as a fuse element, and which has an operating temperature of 145° C. (Japanese Patent Application Laying-Open No. 59-8231). However, these thermal fuses contain harmful metals such as Cd and Pb, and cannot satisfy the above-mentioned requirements for environment conservation. Also a thermal fuse of an operating temperature of 135 to 145° C. in which 0.1 to 5 weight parts of Ag are mixed to 100 weight parts of an alloy of 1 to 3 Sn-balance In is known (Japanese Patent Application Laying-Open No. 2002-25404). The fuse element contains a large amount of In which is a highly reactive element. Therefore, In in the alloy surface reacts with a flux to be dissolved into the flux surrounding the fuse element. When this is repeated, the alloy composition of the fuse element is changed in the direction of a reduction of the amount of In, and the function of the flux is lowered, so that the operation performance of the fuse element is inevitably changed with age. After an elapse of a long term, therefore, the fuse element cannot be assured to perform a predetermined operation performance.

In an alloy for a fuse element of an operating temperature of about 150° C., it is requested that its liquidus temperature is approximately 150° C. Various alloys which satisfy the requirement that a fuse element is free from a harmful metal, in addition to the temperature requirement are known. In these alloys, however, the above-mentioned solid-liquid coexisting region temperature width ΔT is large, and the above-mentioned requirements such as the reduced dispersion of the operating temperature, and the operation stability to a heat cycle are hardly satisfied. In 50Bi-50Sn, for example, the liquidus temperature is about 154° C., and a harmful metal is not contained. In a Bi—Sn alloy, the solidus temperature is constant or 139° C., and the solid-liquid coexisting region temperature width ΔT is as large as about 15° C., so that the requirements cannot be sufficiently satisfied.

SUMMARY OF THE INVENTION

It is an object of the invention to provide an alloy type thermal fuse in which a fuse element does not contain a harmful metal, the operating temperature is about 150° C., the dispersion of the operating temperature can be sufficiently suppressed, and the operation stability to a heat cycle can be satisfactorily assured.

It is another object of the invention to provide an alloy type thermal fuse in which, in addition to the object, the specific resistance of a fuse element can be sufficiently lowered, and mechanical characteristics are satisfactorily improved, so that a process of thinning the fuse element, a high operation accuracy, and the thermal resistance stability to a heat cycle can be satisfactorily assured.

In embodiment 1 of the invention, an alloy composition is 30 to 70% Sn, 0.3 to 20% Sb, and a balance Bi. In embodiment 2 of the invention, a preferred alloy composition is 38 to 50% Sn, 3 to 9% Sb, and a balance Bi.

In embodiment 3 of the invention, 0.1 to 7 weight parts of one, or two or more metals selected from the group consisting of Ag, Au, Cu, Ni, Pd, and Pt are added to 100 weight parts of the alloy of the composition of embodiment 1 or 2.

In embodiment 4 of the invention, a wire member for a thermal fuse element of any one of embodiments 1 to 3 is used as a fuse element. In embodiment 5 of the invention, a heating element for fusing off the fuse element is additionally disposed.

In each of the embodiments, the alloy composition is allowed to contain inevitable impurities which are produced in productions of metals of raw materials and also in melting and stirring of the raw materials.

According to the invention, it is possible to obtain a wire member for a thermal fuse element of an Sn—Sb—Bi alloy in which has a liquidus temperature of about 150° C., a solid-liquid coexisting region temperature width ΔT of 7° C. or narrower, and sufficient ductility, and also to provide an alloy type thermal fuse which does not contain a metal harmful to a living body and therefore is suitable for environment conservation, and in which the dispersion of the operating temperature can be suppressed to a very low level, semi-melting of a fuse element in a heat cycle can be surely prevented from occurring, the initial operation characteristic can be satisfactorily maintained, and the fuse element can be easily thinned, so that the thermal fuse can be sufficiently miniaturized.

According to embodiment 3, particularly, the workability of the fuse element is further improved, the specific resistance is further lowered, and the stress/strain characteristic is further improved. Therefore, miniaturization based on the thinning of the fuse element, improvement of the stability to stress/strain in a heat cycle, and further reduction of deviation of the operating temperature due to Joule's heat of the fuse element can be effectively promoted in the alloy type thermal fuse.

DETAILED DESCRIPTION OF THE PREFERRED EMBODIMENTS

Figure 1:
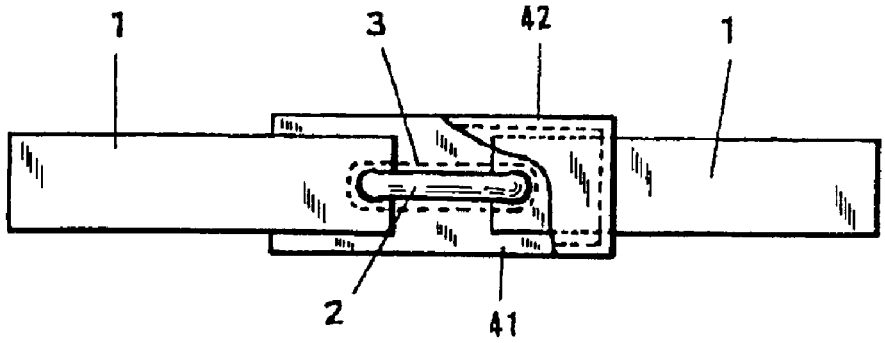
FIG. 1 is a view showing an example of the alloy type thermal fuse of the invention.

In the invention, the fuse element has an alloy composition of 30 to 70% Sn, 0.3 to 20% Sb, and the balance Bi because of the following reason. The liquidus temperature is first set to the vicinity of 140° C., and ductility required for drawing is provided by using 30 to 70% Sn and 10 to 69.7% Bi. The liquidus temperature is then set to about 150° C. while suppressing the solid-liquid coexisting region temperature width ΔT is set to a sufficiently small value, by using 0.3 to 20% Sb.

When Sn is larger than 70%, the liquidus temperature is hardly set to about 150° C. When Sn is smaller than 30%, the amount of Bi is excessively large, so that the ductility is insufficient, and the electrical resistance is excessively high.

When Sb is added, the solidus temperature is raised, and the liquidus temperature of the alloy can be raised while the solid-liquid coexisting region temperature width ΔT is suppressed (7° C. or narrower), unlike addition of a metal element which is usually used for raising the liquidus temperature while maintaining the solidus temperature constant. When Sb is smaller than 0.3%, the effect of raising the solidus temperature is insufficient. When Sb is larger than 20%, it is difficult to set the liquidus temperature of the alloy to about 150° C.

A preferred alloy composition is 38 to 50% Sn, 3 to 9% Sb, and the balance Bi. In the composition, both the mechanical strength and the low electrical resistance can be satisfactorily assured. The reference composition is 43% Sn, 6% Sb, and 51% bi. In the composition, the liquidus temperature is 148° C., and the solid-liquid coexisting region temperature width ΔT is 3° C.

According to the alloy composition, it is possible to provide an alloy type thermal fuse which does not contain a harmful metal such as Pb, Cd, Hg, or Tl and hence is suitable for environment conservation, and in which the operating temperature is about 150° C., the dispersion of the operating temperature is very small, and disturbance of the operation performance due to repetition of non-divisional semi-melting and resolidification of the fuse element in a heat cycle can be surely eliminated.

In the invention, 0.1 to 7 weight parts of one, or two or more metals selected from the group consisting of Ag, Au, Cu, Ni, Pd, and Pt are added to 100 weight parts of the alloy composition because of the following reason. The specific resistance of the alloy is lowered, and the crystal structure is made fine to reduce the interface between different phases in the alloy, whereby process strain and stress can be well dispersed. Namely, the absorbability with respect to strain and stress is enhanced. When the addition amount is smaller than 0.1 weight parts, the effects cannot be satisfactorily attained. When the addition amount is larger than 7 weight parts, it is difficult to hold the liquidus temperature to about 150° C. Therefore, a slip in an interface between different phases in the alloy structure with respect to thermal strain in a heat cycle is sufficiently suppressed to assure the thermal resistance stability to a heat cycle, and a sufficient strength to drawing is provided to enable a process of drawing into a thin wire of a diameter of 300 μmϕ.

The fuse element of the alloy type thermal fuse of the invention can be produced by a method in which a billet is produced, the billet is shaped into a stock wire by an extruder, and the stock wire is drawn by a dice to a wire. The outer diameter is 200 to 600 μmϕ, preferably, 250 to 350 μmϕ. The wire can be finally passed through calender rolls so as to be used as a flat wire.

Alternatively, the fuse element may be produced by the rotary drum spinning method in which a cylinder containing cooling liquid is rotated, the cooling liquid is held in a layer-like manner, and a molten material jet ejected from a nozzle is introduced into the cooling liquid layer to be cooled and solidified, thereby obtaining a thin wire member.

The invention may be implemented in the form of a thermal fuse serving as an independent thermoprotector. Alternatively, the invention may be implemented in the form in which a thermal fuse element is connected in series to a semiconductor device, a capacitor, or a resistor, a flux is applied to the element, the flux-applied fuse element is placed in the vicinity of the semiconductor device, the capacitor, or the resistor, and the fuse element is sealed together with the semiconductor device, the capacitor, or the resistor by means of resin mold, a case, or the like.

FIG. 1 shows a tape-like alloy type thermal fuse according to the invention. In the fuse, strip lead conductors 1 having a thickness of 100 to 200 μm are fixed by an adhesive agent or fusion bonding to a plastic base film 41 having a thickness of 100 to 300 μm. A fuse element 2 is connected between the strip lead conductors. The fuse element 2 has a diameter of 250 to 500 μmϕ, and an alloy composition of 30 to 70% Sn, 0.3 to 20% Sb, and a balance Bi (preferably, 38 to 50% Sn, 3 to 9% Sb, and a balance Bi). In the fuse element 2, alternatively, 0.1 to 7 weight parts of one, or two or more metals selected from the group consisting of Ag, Au, Cu, Ni, Pd, and Pt are added to 100 weight parts of the alloy composition. A flux 3 is applied to the fuse element 2. The flux-applied fuse element is sealed by means of fixation of a plastic cover film 42 having a thickness of 100 to 300 μm by an adhesive agent or fusion bonding.

Figure 2:
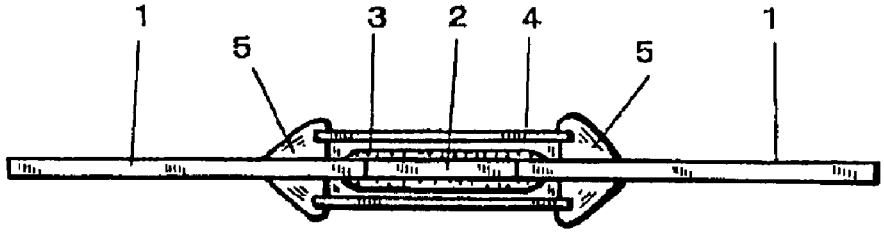
FIG. 2 is a view showing another example of the alloy type thermal fuse of the invention.

FIG. 2 shows a fuse of the cylindrical case type. A fuse element 2 is connected between a pair of lead wires 1.

The fuse element 2 has an alloy composition of 30 to 70% Sn, 0.3 to 20% Sb, and a balance Bi (preferably, 38 to 50% Sn, 3 to 9% Sb, and a balance Bi). In the fuse element 2, alternatively, 0.1 to 7 weight parts of one, or two or more metals selected from the group consisting of Ag, Au, Cu, Ni, Pd, and Pt are added to 100 weight parts of the alloy composition. A flux 3 is applied to the fuse element 2. The flux-applied fuse element is passed through an insulating tube 4 which is excellent in heat resistance and thermal conductivity, for example, a ceramic tube. Gaps between the ends of the insulating tube 4 and the lead wires 1 are sealingly closed by a cold-setting sealing agent 5 such as an epoxy resin.

Figure 3:
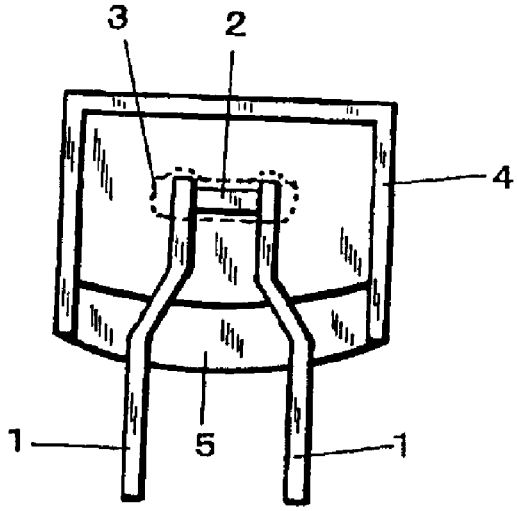
FIG. 3 is a view showing a further example of the alloy type thermal fuse of the invention.

FIG. 3 shows a fuse of the radial case type. A fuse element 2 is bonded between tip ends of parallel lead conductors 1 by welding. The fuse element 2 has an alloy composition of 30 to 70% Sn, 0.3 to 20% Sb, and a balance Bi (preferably, 38 to 50% Sn, 3 to 9% Sb, and a balance Bi). In the fuse element 2, alternatively, 0.1 to 7 weight parts of one, or two or more metals selected from the group consisting of Ag, Au, Cu, Ni, Pd, and Pt are added to 100 weight parts of the alloy composition. A flux 3 is applied to the fuse element 2. The flux-applied fuse element is enclosed by an insulating case 4 in which one end is opened, for example, a ceramic case. The opening of the insulating case 4 is sealingly closed by a sealing agent 5 such as an epoxy resin.

Figure 4:
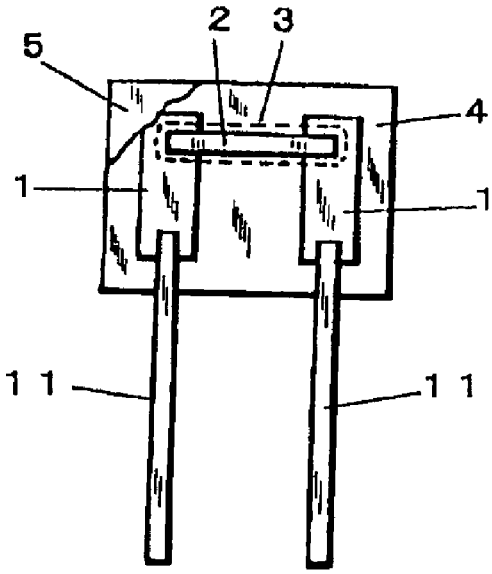
FIG. 4 is a view showing a still further example of the alloy type thermal fuse of the invention.

FIG. 4 shows a fuse of the substrate type. A pair of film electrodes 1 are formed on an insulating substrate 4 such as a ceramic substrate by printing of conductive paste (for example, silver paste). Lead conductors 11 are connected respectively to the electrodes 1 by welding or the like. A fuse element 2 is bonded between the electrodes 1 by welding. The fuse element 2 has an alloy composition of 30 to 70% Sn, 0.3 to 20% Sb, and a balance Bi (preferably, 38 to 50% Sn, 3 to 9% Sb, and a balance Bi). In the fuse element 2, alternatively, 0.1 to 7 weight parts of one, or two or more metals selected from the group consisting of Ag, Au, Cu, Ni, Pd, and Pt are added to 100 weight parts of the alloy composition. A flux 3 is applied to the fuse element 2. The flux-applied fuse element is covered by a sealing agent 5 such as an epoxy resin.

Figure 5:
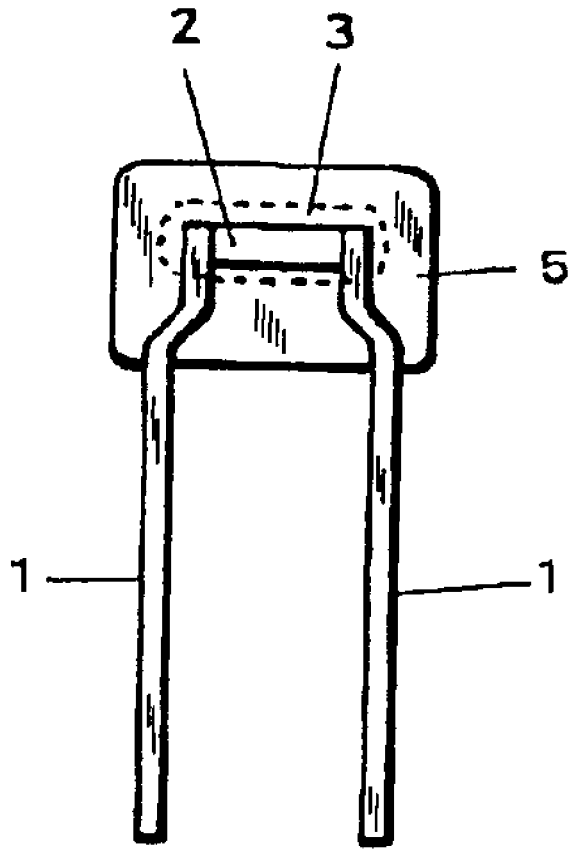
FIG. 5 is a view showing a still further example of the alloy type thermal fuse of the invention.

FIG. 5 shows a fuse of the radial resin dipping type. A fuse element 2 is bonded between tip ends of parallel lead conductors 1 by welding. The fuse element 2 has an alloy composition of 30 to 70% Sn, 0.3 to 20% Sb, and a balance Bi (preferably, 38 to 50% Sn, 3 to 9% Sb, and a balance Bi). In the fuse element 2, alternatively, 0.1 to 7 weight parts of one, or two or more metals selected from the group consisting of Ag, Au, Cu, Ni, Pd, and Pt are added to 100 weight parts of the alloy composition. A flux 3 is applied to the fuse element 2. The flux-applied fuse element is dipped into a resin solution to seal the element by an insulative sealing agent 5 such as an epoxy resin.

In the alloy type thermal fuse, in the case where Joule's heat of the fuse element is negligible, the temperature Tx of the fuse when the temperature of the appliance to be protected reaches the allowable temperature Tm is lower than Tm by 2 to 3° C., and the melting point of the fuse element is usually set to [Tm−(2 to 3° C.)].

By contrast, in the case where Joule's heat of the fuse element is nonnegligible, when the electrical resistance of the fuse element is R, the current flowing through the fuse element is I, and the thermal resistance between the appliance and the fuse element is H, the following expression holds:

$$Tx=Tm-(2 \text{ to } 3^\circ \text{ C.})+HRI^2.$$

The melting point of the fuse element can be set based on the above expression.

The invention may be implemented in the form in which a heating element is additionally disposed on the alloy type thermal fuse, for example, a film resistor is additionally disposed by applying and baking resistance paste (e.g., paste of metal oxide powder such as ruthenium oxide), a precursor causing abnormal heat generation of an appliance is detected, the film resistor is energized to generate heat in response to a signal indicative of the detection, and the fuse element is fused off by the heat generation.

In this case, the heating element is disposed on the upper face of an insulating substrate, and a heat-resistant and thermal-conductive insulating film such as a glass baked film is formed on the heating element. A pair of electrodes are disposed, flat lead conductors are connected respectively to the electrodes, and the fuse element is connected between the electrodes. A flux covers a range over the fuse element and the tip ends of the lead conductors. An insulating cover is placed on the insulating substrate, and the periphery of the insulating cover is sealingly bonded to the insulating substrate by an adhesive agent.

As the flux, a flux having a melting point which is lower than that of the fuse element is generally used. For example, useful is a flux containing 90 to 60 weight parts of rosin, 10 to 40 weight parts of stearic acid, and 0 to 3 weight parts of an activating agent. In this case, as the rosin, a natural rosin, a modified rosin (for example, a hydrogenated rosin, an inhomogeneous rosin, or a polymerized rosin), or a purified rosin thereof can be used. As the activating agent, hydrochloride of diethylamine, hydrobromide of diethylamine, an organic acid such as adipic acid can be used.

In each of the following examples, the thermal fuse is of the substrate type, the fuse element has a length of 4 mm, a composition of 80 weight parts of rosin, 20 weight parts of stearic acid, and 1 weight part of hydrobromide of diethylamine was used as a flux, and a cold-setting epoxy resin was used as a covering member.

With respect to the change in resistance of a fuse element caused by heat cycles, 50 specimens were used, and judgment was made by measuring a resistance change after a test of 500 heat cycles in each of which specimens were heated to 120° C. for 30 minutes and cooled to −40° C. for 30 minutes.

While 50 specimens were used and a current of 0.1 A is supplied to the specimens, the specimens were immersed into an oil bath in which the temperature was raised at a rate of 1° C./min., and the operating temperature of the thermal fuse was measured from the temperature of the oil when the current supply was interrupted by blowing-out of the fuse element.

EXAMPLE 1

A base material of an alloy composition of 43% Sn, 6% Sb, and the balance Bi was drawn into a wire of 300 μmϕ in diameter. The draw-down ratio per dice was 6.5%, and the drawing speed was 45 m/min. In the wire, no breakage occurred.

The specific resistance of the wire was measured. As a result, the specific resistance was 37 μΩ·cm.

The liquidus temperature of the wire was 148° C., and the solid-liquid coexisting region temperature width ΔT was 3° C.

Substrate type thermal fuses were produced, and the change in resistance of a fuse element in heat cycles was measured. As a result, the change in resistance was not observed, and the thermal fuses exhibited stable thermal resistance.

The operating temperatures of the thermal fuses were 147° C.±0.5° C., and the dispersion of the temperature was very small.

EXAMPLE 2

A base material of an alloy composition of 43% Sn, 3% Sb, and the balance Bi was drawn into a wire of 300 μmϕ in diameter. The draw-down ratio per dice was 6.5%, and the drawing speed was 45 m/min. In the wire, no breakage occurred.

The specific resistance of the wire was measured. As a result, the specific resistance was 36 μΩ·cm.

The liquidus temperature of the wire was 144° C., and the solid-liquid coexisting region temperature width ΔT was 3° C.

Substrate type thermal fuses were produced, and the change in resistance of a fuse element in heat cycles was measured. As a result, the change in resistance was not observed, and the thermal fuses exhibited stable thermal resistance.

The operating temperatures of the thermal fuses were 143° C.±0.5° C., and the dispersion of the temperature was very small.

EXAMPLE 3

A base material of an alloy composition of 43% Sn, 9% Sb, and the balance Bi was drawn into a wire of 300 μmϕ in diameter. The draw-down ratio per dice was 6.5%, and the drawing speed was 45 m/min. In the wire, no breakage occurred.

The specific resistance of the wire was measured. As a result, the specific resistance was 39 μΩ·cm.

The liquidus temperature of the wire was 152° C., and the solid-liquid coexisting region temperature width ΔT was 4° C.

Substrate type thermal fuses were produced, and the change in resistance of a fuse element in heat cycles was measured. As a result, the change in resistance was not observed, and the thermal fuses exhibited stable thermal resistance.

The operating temperatures of the thermal fuses were 150° C.±1° C., and the dispersion of the temperature was very small.

EXAMPLES 4 to 6

Base materials of alloy compositions listed in Table 1 were drawn into wires of 300 μmϕ in diameter. The ductility is slightly low. Therefore, a drawing process was performed while the draw-down ratio per dice was reduced to 4%, and the drawing speed was lowered to 20 m/min. In the wires, no breakage occurred.

The specific resistances of the wires were measured. As a result, the specific resistances of all the wires were 50 μΩ·cm or smaller, or sufficiently small.

The liquidus temperatures are shown in Table 1. In all of the examples, the solid-liquid coexisting region temperature width ΔT was 7° C. or narrower, or sufficiently narrow.

Substrate type thermal fuses were produced, and the change in resistance of a fuse element in heat cycles was measured. As a result, the change in resistance which may become a serious problem was not observed.

TABLE 1

| | Example 4 | Example 5 | Example 6 |
|---|---|---|---|
| Sn (%) | 38 | 38 | 38 |
| Sb (%) | 3 | 6 | 9 |
| Bi (%) | 59 | 56 | 53 |
| Liquidus temperature (° C.) | 145 | 149 | 153 |

EXAMPLES 7 to 9

Base materials of alloy compositions listed in Table 2 were drawn into wires of 300 μmϕ in diameter. The draw-down ratio per dice was 6.5%, and the drawing speed was 45 m/min. In the wires, no breakage occurred.

The specific resistances of the wires were measured. As a result, the specific resistances of all the wires were 38 $\mu\Omega\cdot$cm or sufficiently small.

The liquidus temperatures are shown in Table 2. In all of the examples, the solid-liquid coexisting region temperature width $\Delta T$ was 7° C. or narrower, or sufficiently narrow.

Substrate type thermal fuses were produced, and the change in resistance of a fuse element in heat cycles was measured. As a result, the change in resistance which may become a serious problem was not observed.

TABLE 2

| | Example 7 | Example 8 | Example 9 |
|---|---|---|---|
| Sn (%) | 50 | 50 | 50 |
| Sb (%) | 3 | 6 | 9 |
| Bi (%) | 47 | 44 | 41 |
| Liquidus temperature (° C.) | 146 | 150 | 155 |

EXAMPLES 10 to 12

Base materials of alloy compositions listed in Table 3 were drawn into wires of 300 $\mu$mϕ in diameter. The draw-down ratio per dice was 6.5%, and the drawing speed was 45 m/min. In the wire, no breakage occurred.

The specific resistances of the wires were measured. As a result, the specific resistances of all the wires were 30 $\mu\Omega\cdot$cm or narrower, or sufficiently narrow.

The liquidus temperatures are shown in Table 3. The solid-liquid coexisting region temperature width $\Delta T$ is 6° C. in Example 10, 5° C. in Example 11, and 6° C. in Example 12. It is expected that dispersion of the operating temperature can be sufficiently reduced.

Substrate type thermal fuses were produced, and the change in resistance of a fuse element in heat cycles was measured. As a result, the change in resistance which may become a serious problem was not observed.

TABLE 3

| | Example 10 | Example 11 | Example 12 |
|---|---|---|---|
| Sn (%) | 70 | 70 | 70 |
| Sb (%) | 3 | 6 | 9 |
| Bi (%) | 27 | 24 | 21 |
| Liquidus temperature (° C.) | 158 | 160 | 162 |

EXAMPLES 13 to 15

Base materials of alloy compositions listed in Table 4 were drawn into wires of 300 $\mu$mϕ in diameter. The ductility is slightly low. Therefore, a drawing process was performed while the draw-down ratio per dice was reduced to 4%, and the drawing speed was lowered to 20 m/min. In the wires, no breakage occurred.

The specific resistances of the wires were measured. As a result, the specific resistances of all the wires were 50 $\mu\Omega\cdot$cm or narrower, or sufficiently narrow.

The liquidus temperatures are shown in Table 4. In all of the examples, the solid-liquid coexisting region temperature width $\Delta T$ was 7° C. or narrower. It is expected that dispersion of the operating temperature can be sufficiently reduced.

Substrate type thermal fuses were produced, and the change in resistance of a fuse element in heat cycles was measured. As a result, the change in resistance which may become a serious problem was not observed.

TABLE 4

| | Example 13 | Example 14 | Example 15 |
|---|---|---|---|
| Sn (%) | 30 | 30 | 30 |
| Sb (%) | 3 | 6 | 9 |
| Bi (%) | 67 | 64 | 61 |
| Liquidus temperature (° C.) | 155 | 157 | 161 |

EXAMPLE 16

A base material of an alloy composition in which 1 weight part of Ag is added to 100 weight parts of an alloy of 38% Sn, 6% Sb, and 56% Bi was drawn into a wire of 300 $\mu$mϕ in diameter. The workability of the example is superior to that of Example 5, and more harsh drawing conditions were applied by setting the draw-down ratio per dice to 6.5% and the drawing speed to 45 m/min. In the wire, no breakage occurred. Since the stress/strain characteristic of the fuse element is improved, it is expected that the change in resistance of a fuse element in heat cycles be reduced.

The specific resistance of the wire was measured. As a result, the specific resistance of the example was sufficiently lower than that of Example 5.

As compared with Example 5, changes of the liquidus temperature and the solid-liquid coexisting region temperature width $\Delta T$ were small.

It was affirmed that, when 0.1 to 7 weight parts of Ag are added, the above effects are attained.

EXAMPLES 16 to 20

Base materials of an alloy composition in each of which 1 weight part of respective one of Au, Cu, Ni, Pd, or Pt is added to 100 weight parts of an alloy of 38% Sn, 6% Sb, and 56% Bi were drawn into wires of 300 $\mu$mϕ in diameter. In all the examples, the workability is superior to that of Example 5. The draw-down ratio per dice was set to 6.5%, and the drawing speed was set to 45 m/min. In all of Examples 16 to 20, no breakage occurred. Since the stress/strain characteristic of the fuse element is improved, it is expected that the change in resistance of a fuse element in heat cycles be reduced.

The specific resistances of Examples 16 to 20 were measured. As a result, the specific resistances were sufficiently lower than that of Example 5.

As compared with Example 5, changes of the liquidus temperature and the solid-liquid coexisting region temperature width $\Delta T$ were small in all of Examples 16 to 20.

It was affirmed that, when 0.1 to 7 weight parts of Au, Cu, Ni, Pd, or Pt are added, the above effects are attained.

COMPARATIVE EXAMPLE 1

A wire was produced in the same manner as Example 1 except that an alloy composition was 50% Bi and 50% Sn. In the wire, no breakage occurred. The specific resistance of the wire was measured. As a result, the specific resistance was 35 $\mu\Omega\cdot$cm. The liquidus temperature of the wire was about 154° C., and the solid-liquid coexisting region temperature width $\Delta T$ was about 15° C. Substrate type thermal fuses were produced, and an initial operation test was conducted. As a result, the operating temperature was dispersed from 140° C. to 154° C., and the dispersion of the operating temperature remarkably appeared.

COMPARATIVE EXAMPLE 2

A wire was produced in the same manner as Example 1 except that an alloy composition was 2% Sn, 3% Ag, and 95% In. In the wire, no breakage occurred. The specific resistance of the wire was measured. As a result, the specific resistance was 10 $\mu\Omega\cdot$cm. The liquidus temperature of the wire was about 144° C., and the solid-liquid coexisting region temperature width $\Delta T$ was about 3° C. Substrate type thermal fuses were produced, and the change in resistance of a fuse element in heat cycles was measured. As a result, there was a fuse element which exhibited a resistance increase of 50% or more at the maximum. An operating temperature check test was conducted. As a result, there was a fuse element which did not operate even when the temperature was raised by 10° C. or more from the initial operating temperature (144° C.). The cause of this phenomenon was investigated by the plasma emission spectrometry, the infrared absorption spectrometry, etc. It was found that the wire diameter is further reduced as the alloy composition is varied by dissolution of In into the flux, and most of reactive groups concerned with the activity of the flux are formed into In salts. Namely, the above-discussed fears were affirmed.

What is claimed is:

1. A wire member for a thermal fuse element wherein said wire element has an alloy composition of 30 to 70% Sn, 0.3 to 20% Sb, and a balance Bi.

2. A wire member for a thermal fuse element wherein said wire element has an alloy composition of 38 to 50% Sn, 3 to 9% Sb, and a balance Bi.

3. A wire member for a thermal fuse element wherein 0.1 to 7 weight parts of one, or two or more metals selected from the group consisting of Ag, Au, Cu, Ni, Pd, and Pt are added to 100 weight parts of an alloy according to claim 1.

4. A wire member for a thermal fuse element wherein 0.1 to 7 weight parts of one, or two or more metals selected from the group consisting of Ag, Au, Cu, Ni, Pd, and Pt are added to 100 weight parts of an alloy according to claim 2.

5. An alloy type thermal fuse wherein a wire member for a thermal fuse element according to claim 1 is used as a fuse element.

6. An alloy type thermal fuse wherein a wire member for a thermal fuse element according to claim 2 is used as a fuse element.

7. An alloy type thermal fuse wherein a wire member for a thermal fuse element according to claim 3 is used as a fuse element.

8. An alloy type thermal fuse wherein a wire member for a thermal fuse element according to claim 4 is used as a fuse element.

9. An alloy type thermal fuse according to claim 5, wherein a heating element for fusing off said fuse element is additionally disposed.

10. An alloy type thermal fuse according to claim 6, wherein a heating element for fusing off said fuse element is additionally disposed.

11. An alloy type thermal fuse according to claim 7, wherein a heating element for fusing off said fuse element is additionally disposed.

12. An alloy type thermal fuse according to claim 8, wherein a heating element for fusing off said fuse element is additionally disposed.

* * * * *